US005398527A

United States Patent [19]

Hirai et al.

[11] Patent Number: 5,398,527

[45] Date of Patent: Mar. 21, 1995

[54] FLAT KNITTING MACHINE HAVING A TRANSFERRING MECHANISM

[75] Inventors: Ikuhito Hirai; Takekazu Shibuta, both of Wakayama, Japan

[73] Assignee: Shima Seiki Mfg., Ltd., Wakayama, Japan

[21] Appl. No.: 138,053

[22] Filed: Oct. 19, 1993

[30] Foreign Application Priority Data

Oct. 22, 1992 [JP] Japan ..... 4-284233

[51] Int. Cl.[6] ..... D04B 7/00

[52] U.S. Cl. ..... 66/148; 66/61; 66/64; 66/120

[58] Field of Search ..... 66/60 R, 61, 64, 66, 66/69, 120, 148

[56] References Cited

U.S. PATENT DOCUMENTS

| | | | |
|---|---|---|---|
| 1,531,272 | 3/1925 | Burson | 66/66 |
| 4,637,228 | 1/1987 | Shima | 66/120 X |
| 4,905,483 | 3/1990 | Shima | 66/64 |

FOREIGN PATENT DOCUMENTS

| | | | |
|---|---|---|---|
| 106859 | 1/1900 | Germany | 66/61 |
| 638228 | 4/1962 | Italy | 66/64 |
| 417907 | 4/1941 | Japan . | |
| 56-21854 | 5/1981 | Japan . | |
| 63-256752 | 10/1988 | Japan . | |
| 1-168943 | 7/1989 | Japan . | |
| 1-57173 | 12/1989 | Japan . | |
| 27730 | 12/1903 | United Kingdom | 66/61 |
| 26249 | 12/1905 | United Kingdom | 66/61 |

*Primary Examiner*—John J. Calvert

*Attorney, Agent, or Firm*—Armstrong, Westerman, Hattori, McLeland & Naughton

[57] ABSTRACT

A flat knitting machine with a transferring mechanism comprising a pair of needle beds arranged facing each other to form an inverted V-shaped form in a side view and to form an aperture between adjoining end portions of the needle beds, knitting needles arranged in needle grooves formed on the needle beds, a yarn feeder arranged above the aperture between the needle beds, each carriage being reciprocally movable on each of the needle beds and having cam surface on a lower surface of the carriage for moving the knitting needles forward and backward, each transferring jack bed is supported by a supporting member above each of the needle beds, a transferring jack having a transfer jack selected member and arranged swingably and movably forward and backward in a jack groove formed on each transferring bed, and a transfer jack selecting unit acting on the transfer jack selected member and arranged at an edge portion of the carriage, which is adjoining to the aperture. The needle bed and the transferring jack bed are relatively movable.

5 Claims, 18 Drawing Sheets

FLAT KNITTING MACHINE HAVING A TRANSFERRING MECHANISM

BACKGROUND OF THE INVENTION

1. Field of the Invention

The present invention relates to an improvement of a flat knitting machine having a transferring mechanism.

2. Description of the Related Art

In a usual flat knitting machine, a pair of needle beds which contain movable knitting needles are arranged to form an inverted V-shaped form in a side view.

To solve this problem, Japanese Examined Patent Publication No. 41-7907 discloses a flat knitting machine, wherein a pair of needles beds, containing movable knitting needles, are arranged to form an inverted V-shaped form in a side view. A transferring jack bed, containing movable jacks in jack grooves, is provided above each needle bed. A stitch to be transferred is transferred from the knitting needle to the transferring jack, and the stitch engaged with the transferring jack is transferred to another knitting needle after the transferring jack engaged with the stitch is moved in a transverse direction.

Further, Japanese Unexamined Patent Publication No. 1-168943 discloses a flat knitting machine, wherein a transferring jack bed is supported above a needle bed by supporting members. Transferring jacks, at the front ends of which stitch engaging portions are formed, are movably arranged in the transferring bed. The transferring jacks are moved forward and backward by a transferring cam accompanied with a carriage. The transferring jack bed is moved in a transverse direction by a driving means provided at one side of the transferring jack bed. A stitch engaged with the stitch engaging portion is moved in a transverse direction and the stitch is transferred to another knitting needle.

Furthermore, Japanese Examined Patent Publication No. 1-57173, of the present applicant, discloses a flat knitting machine, wherein what is called "four beds" is formed by arranging a pair of front and rear needle beds upward and downward. A stitch is transferred by moving knitting needles in each of the needle beds and the stitch can be transferred in a transverse direction by moving each of the needle beds in such transverse direction.

Furthermore, Japanese Examined Patent Publication No. 56-21854, of the present applicant, and Japanese Unexamined Patent Publication No. 63-256752 discloses a flat knitting machine, wherein a transferring bed, containing movable jacks in jack grooves, is provided above a needle bed. A stitch to be transferred is transferred from the knitting needle to the transferring jack. The stitch engaged with the transferring jack is transferred to another knitting needle after the transferring jack engaged with the stitch is moved in a transverse direction.

In the flat knitting machines having a transferring mechanism disclosed in Japanese Unexamined Patent Publication No. 63-256752, Japanese Examined Patent Publication No. 56-21854, and the transferring jack or knitting needle which receives the stitch to be transferred is moved transversely. Because the transferring jack or the knitting needle is kept in a protruding position, when moved transversely, such protruding jack or needle interferes with a projected portion like a sinker formed at the top portion of the needle bed. Therefore, to avoid such interference, the otherwise interfering tip portion of the transferring jack or knitting needle, which receives the stitch, must be raised by a raising device. When the raising device is proved, however, a problem arises in that the construction of the transferring mechanism becomes complicated and the side of the transferring mechanism becomes large.

Further, in the flat knitting machine having a transferring mechanism disclosed in Japanese Examined Patent Publication No. 1-57173, because the font and rear needles beds arranged upward have a knitting function, forming a loop, hooking a loop, disengaging a loop, a transfer, that is, forming a tuck, and the like, are the same size as the needle beds which are arranged downward. A problem arises in that the construction of the flat knitting machine becomes complicated as well as the size of the flat knitting machine becomes large as comparing to other flat knitting machines disclosed in other Patent Publications.

Furthermore, in the flat knitting machine having a transferring mechanism disclosed in Japanese Examined Patent Publication No. 41-7907, only related actions between the knitting needles and the transferring jack are disclosed. Accordingly, when the knitting needles and the transferring jack are moved forward or backward by a usual carriage or a transferring cam accompanied by the carriage, because the knitting needle and the transferring jack are always moved forward or backward by the carriage or the transferring cam, the jack butts of the transferring jack, which are moved or are being moved by the carriage or the transferring cam, become obstacles when the carriage or the transferring cam is moved in an adverse direction at any position on the needle bed. Therefore, in this flat knitting machine, because the carriage, or the transferring cam, cannot be moved in an adverse direction at any position on the needle bed, the carriage should be moved reciprocally over the entire width of the needle bed. As a result, a problem arises in that the number of the knitting courses per unit time reduces and thus productivity becomes considerably low. Especially, this problem emerges obviously when cloth with narrow width is knitted by a wide flat knitting machine by which cloth having large wale number can be knitted.

SUMMARY OF THE INVENTION

An object of the present invention is to provide a flat knitting machine capable of reducing the size of the flat knitting machine by reducing the size of the transferring mechanism and arranging the transferring mechanism at a dead space, increasing the number of knitting courses per unit time by making possible that the carriage and the transferring cam is moved adversely at any position on the needle bed, and thus increasing the productivity of the flat knitting machine remarkably.

According to the present invention, a flat knitting machine having a transferring mechanism, comprising: a pair of needled beds arranged facing each other to form an inverted V-shaped form in a side view with an aperture being formed between adjoining end portions of the needle beds. Knitting needles are positioned in needle grooves formed on the needle beds. A yarn feeder is positioned above the aperture between the needle beds. Each carriage is reciprocally movable on each of the needle beds and have a cam surface on a lower surface of the carriage for moving the knitting needles forward and backward. Each transferring jack bed is supported by a supporting member above each of the needles beds, and the needle bed and the transferring jack bed are relatively movable. A transferring jack, having a needle selected member and arranged swingably and movably forward and backward in a jack groove, are formed on each transferring bed. A needle selecting means acting as the needle selected member and arranged at an edge portion of the carriage adjoining to the aperture.

In this flat knitting machine, the carriage moves reciprocally on the needle bed. The knitting needles are moved forward and backward in the needle grooves because the cam surface acts on each butt of the predetermined knitting needles. Knitted goods, with a predetermined width, are knitted by feeding yarn from the yarn feeder.

When stitches are reduced inward to reduce the width of the knitted goods, the stitch to be moved inward is transferred from the knitting needle to the transferring jack. In this case, the knitting needle, which retains the stitch, is pushed forward toward the transferring position by the carriage. The needle selected member of the transferring jack, which should receive the stitch, is selected by the needle selecting means. The transferring jack, which was selected, is moved forward and backward. The stitch to be moved inward is transferred from the knitting needle to the transferring jack.

Then, after the needle bed and the transferring jack bed are relatively moved so that the transferring jack, which retains the stitch, faces stitches retained by the knitting needles of the needle bed, the stitch is transferred from the transferring jack to the needle bed and, thus, inner reduction is completed.

In the case where knitted goods, with predetermined width, are knitted, or the stitch is reduced inward to reduce the width of the knitted goods, because the needle selected member of the transferring jack, selected by the transfer jack selected member, is returned to the position prior to the needle selection, when the carriage is moved to outside of the width of the knitted goods, the transfer jack selected member of the transferring jack does not prevent the carriage from moving when the carriage is moved in an adverse direction. Accordingly, the carriage can be moved in an adverse direction at any point, whether the carriage is within the width of the knitted goods or outside the width thereof.

Further, in the flat knitting machine of the present invention, the transfer jack selected member may be formed by forming transfer jack selected butt at a tail portion of the transferring jack, and the transfer jack selected member may comprise an actuator which directly operates the transfer jack selected butt. In this flat knitting machine, the transferring jack can be selected individually.

Furthermore, in the flat knitting machine of the present invention, the transferring jack may comprise more than two kinds of jacks which have different transfer jack selected members with different phases, transferring jack groups may be formed from a plurality of transferring jacks of the same kind, and the transferring jack groups of different kinds may be arranged alternatively each predetermined width. In this flat knitting machine, the speed of the carriage can be increased.

Furthermore, in this flat knitting machine of the present invention, the transfer jack selected member may comprise a jack butt which is protruded upward at a tail portion of the transferring jack and has different phases, and a return operation surface which is protruded downward. The transfer jack selecting means may comprise actuators for acting the transfer jack selected butt, respectively, with different phases and a return cam, for returning the transfer jack selected butt to a moving direction of the carriage at a surface of the carriage facing to the transfer jack selected member. Also, in this flat knitting machine of the present invention, the actuator may have two convex portions and a recess portion between the two convex portions faces to a return cam. In this flat knitting machine, the size of the needle means can be reduced.

The present invention may be more fully understood from the description of preferred embodiments of the invention set forth below, together with the accompanying drawings.

BRIEF DESCRIPTION OF THE DRAWINGS

Figure 1:
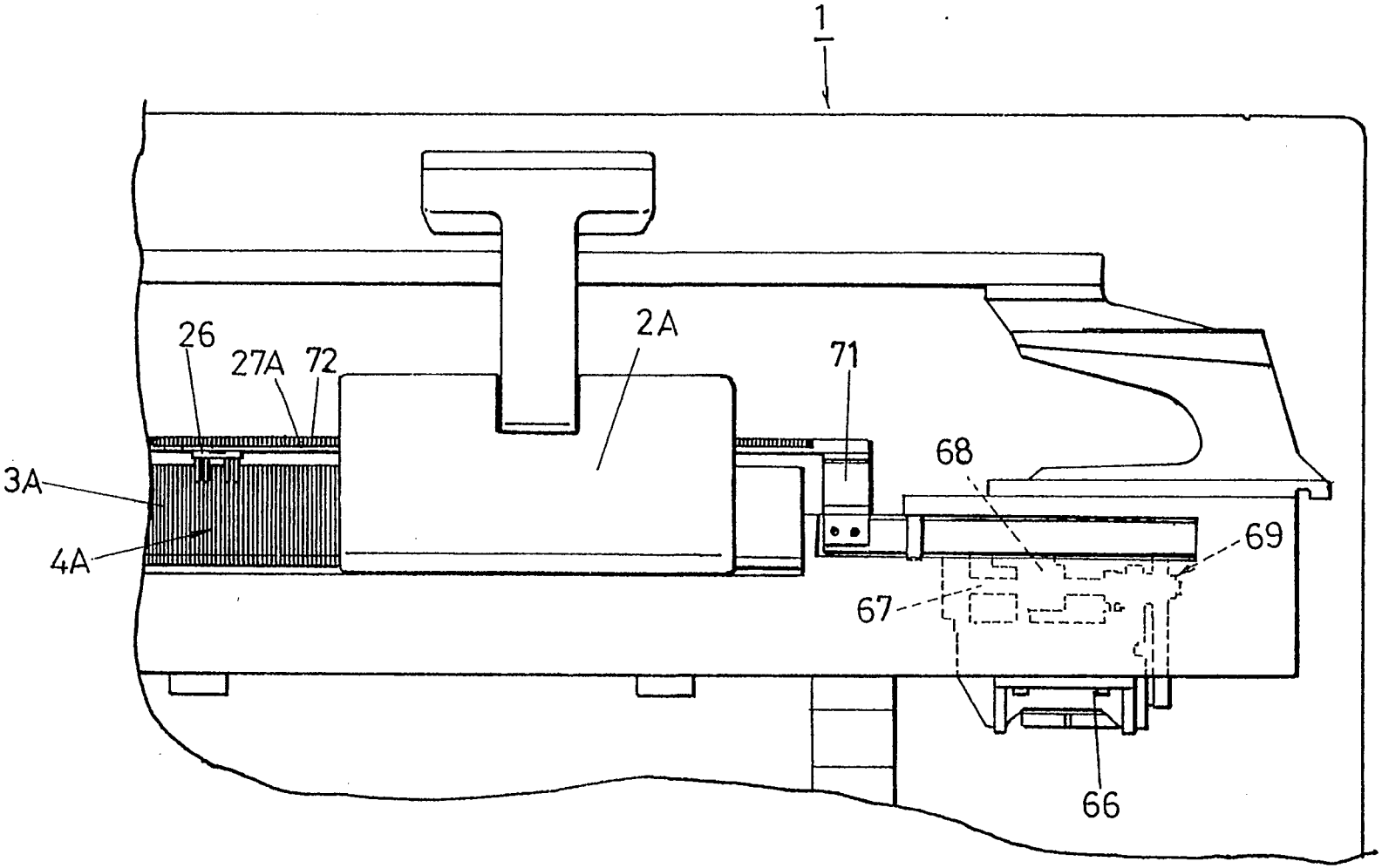
Figure 2:
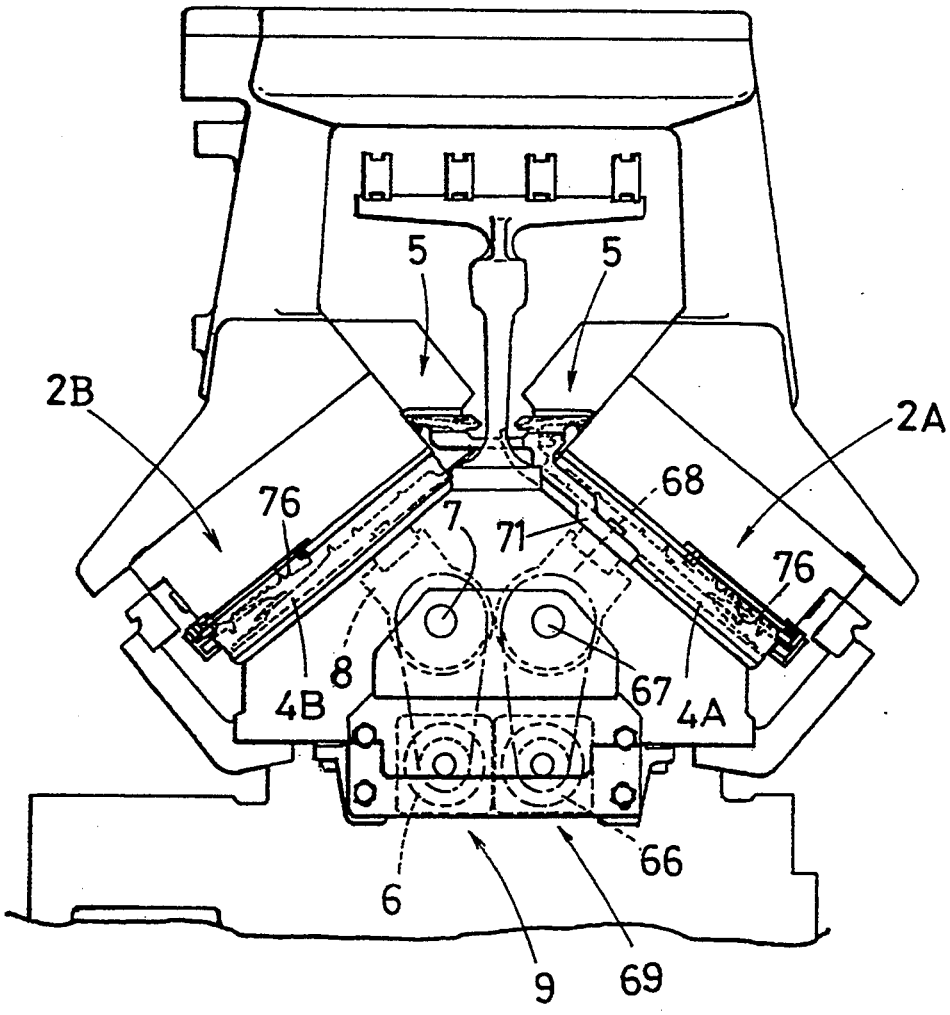
Figure 3:
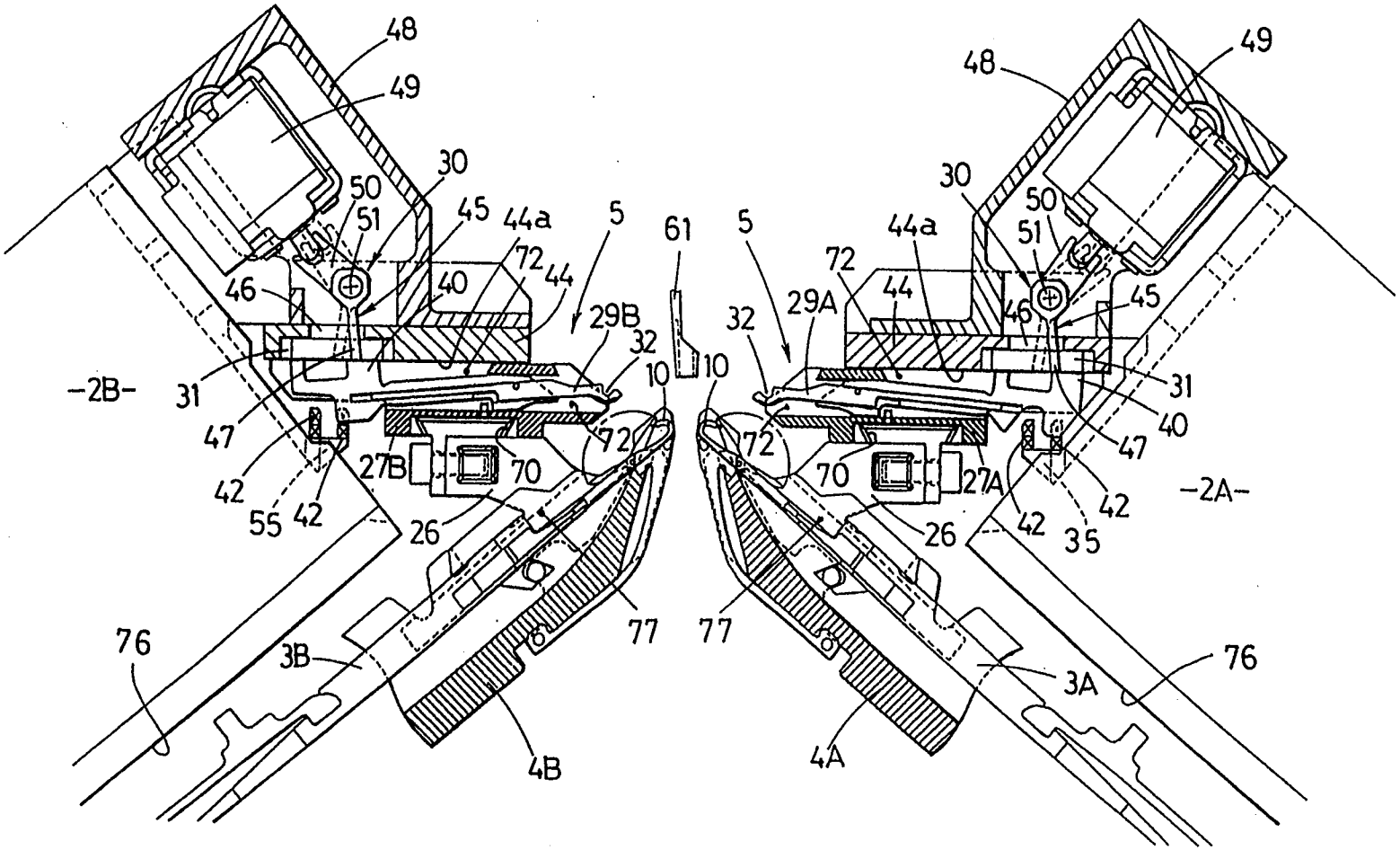
Figure 4:
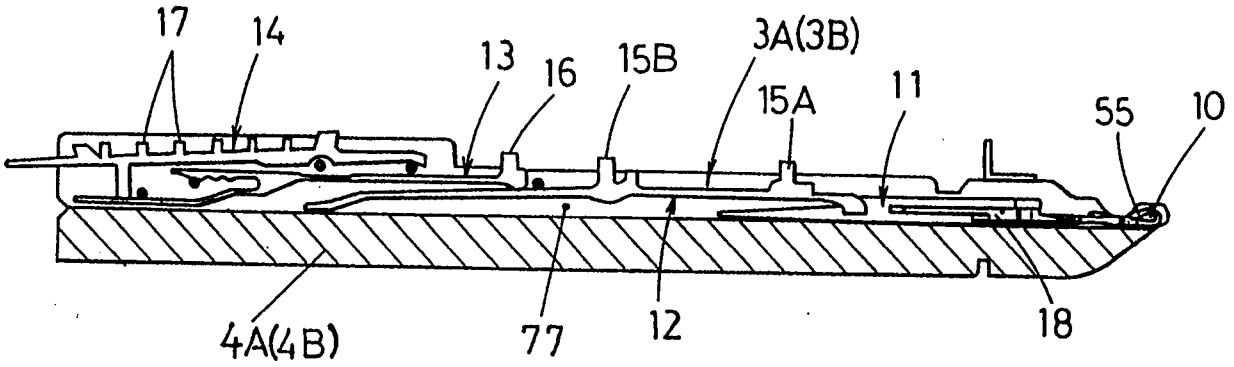
Figure 5:
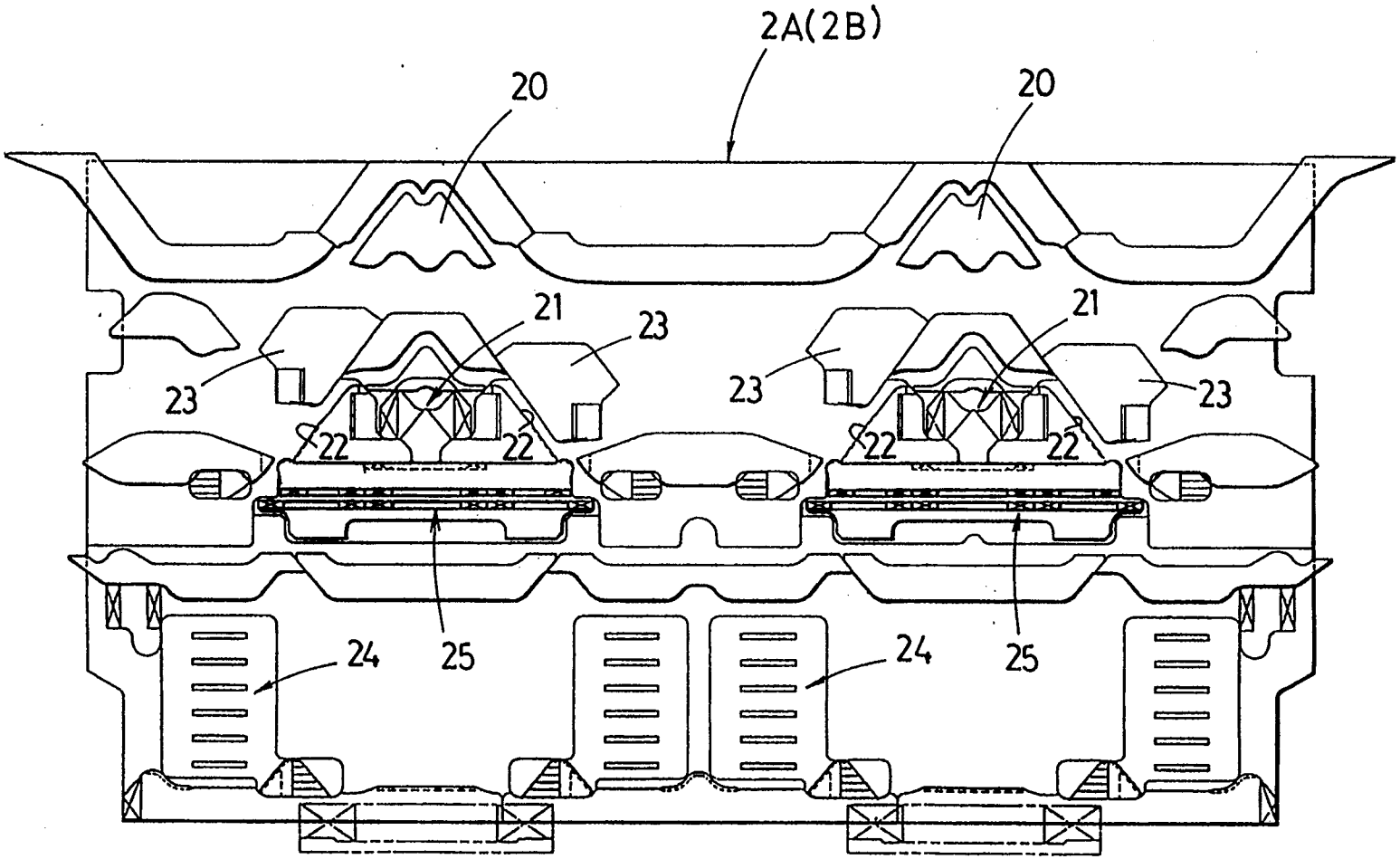
Figure 6:
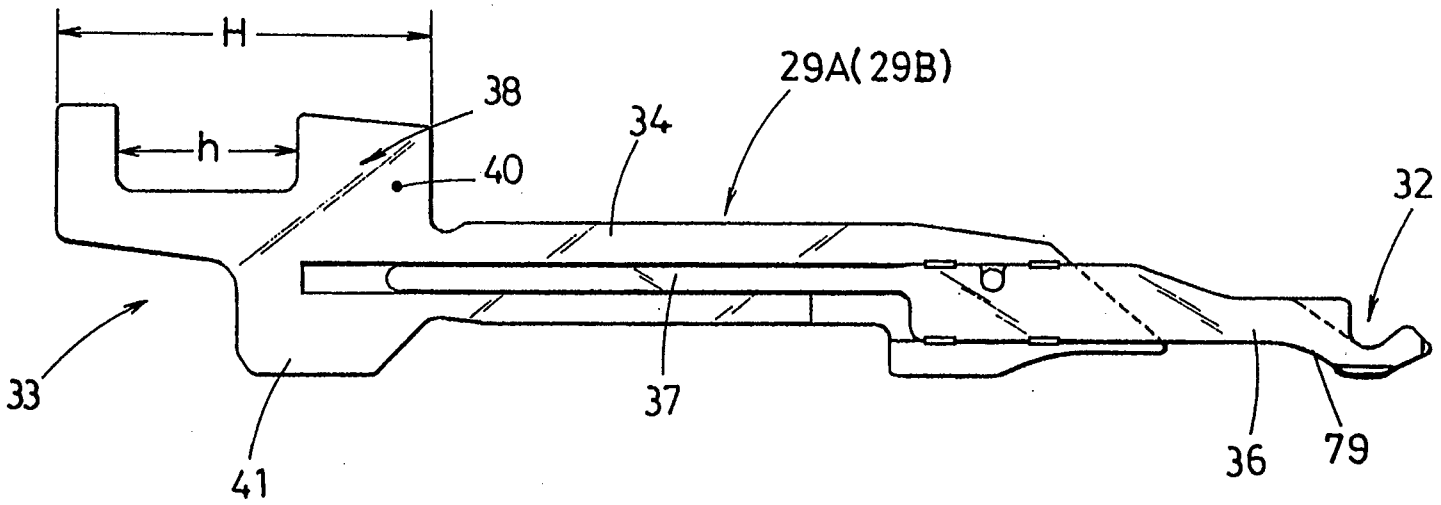
Figure 7:
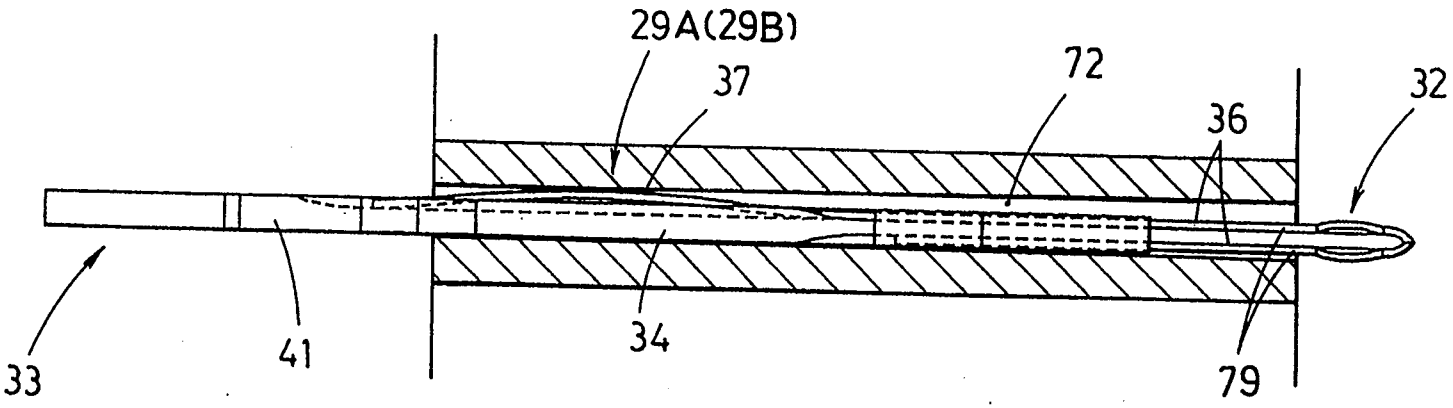
Figure 8:
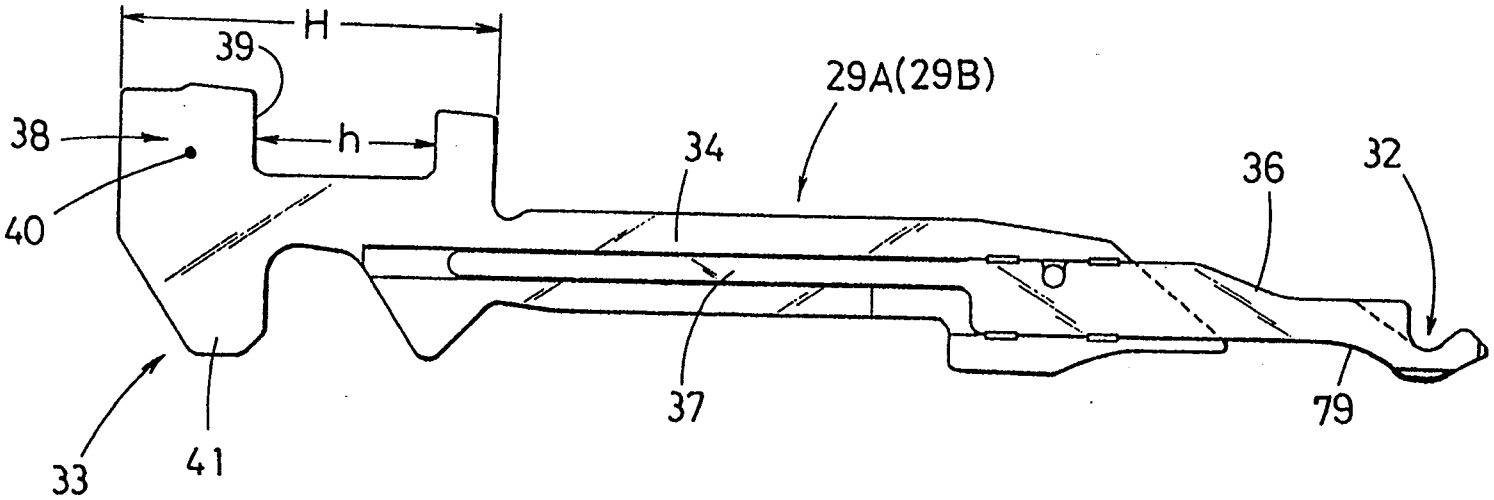
Figure 9:
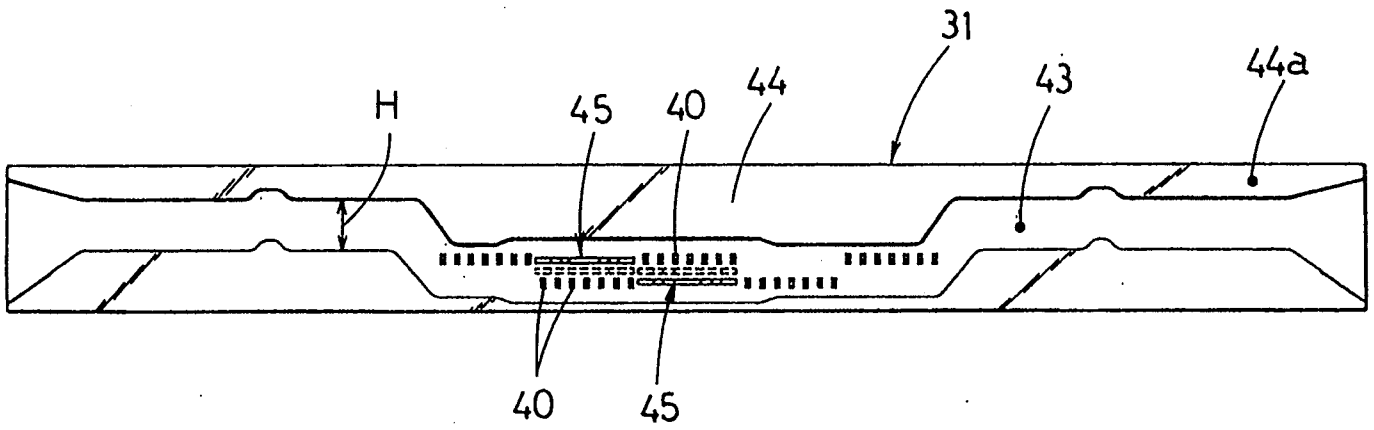
Figure 10:
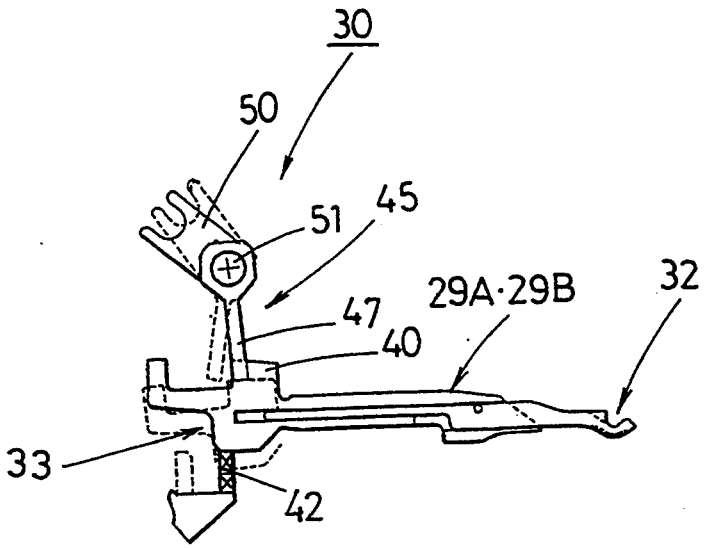
Figure 11:
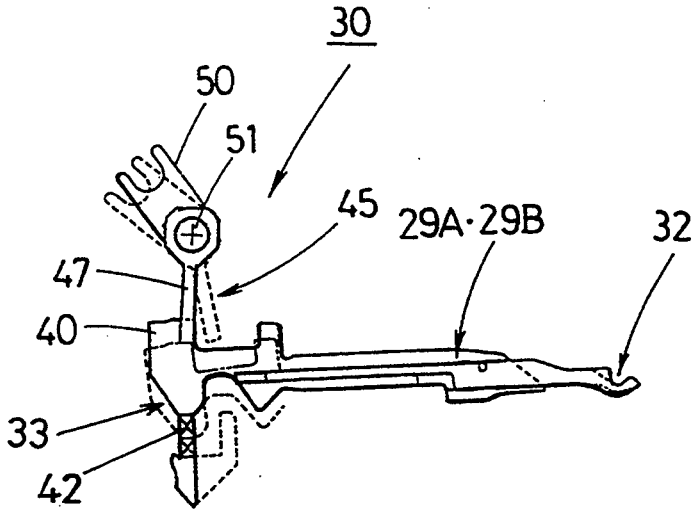
Figure 12:
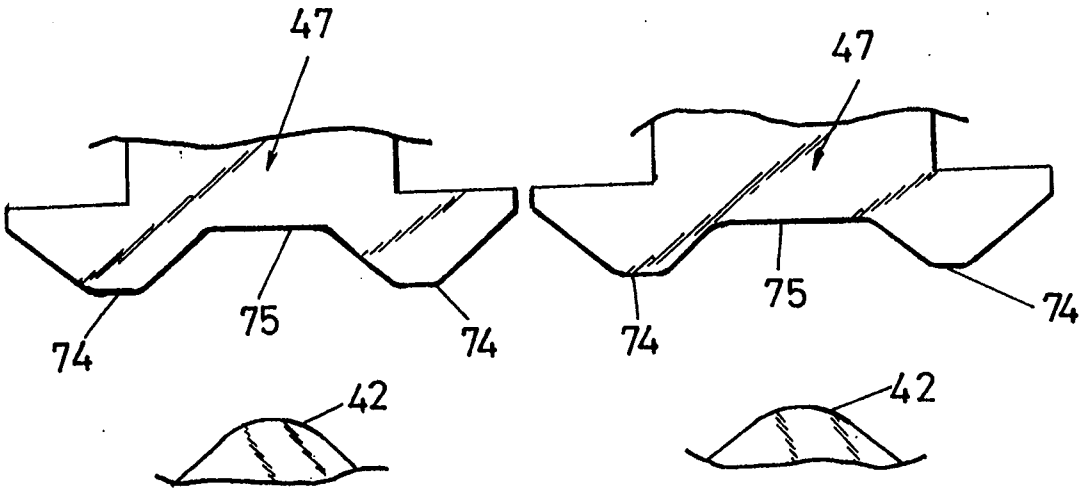
Figure 13:
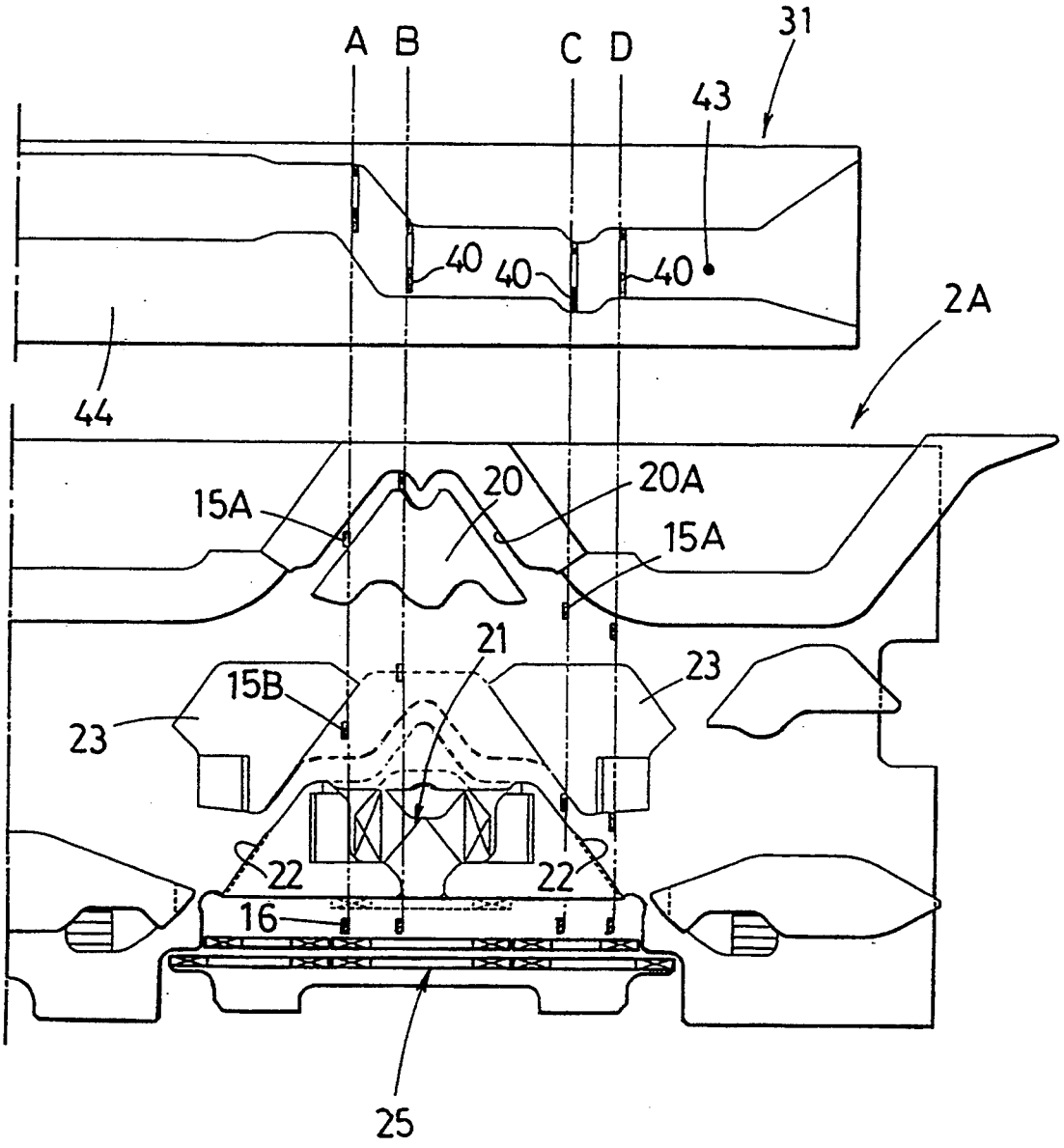
Figure 15:
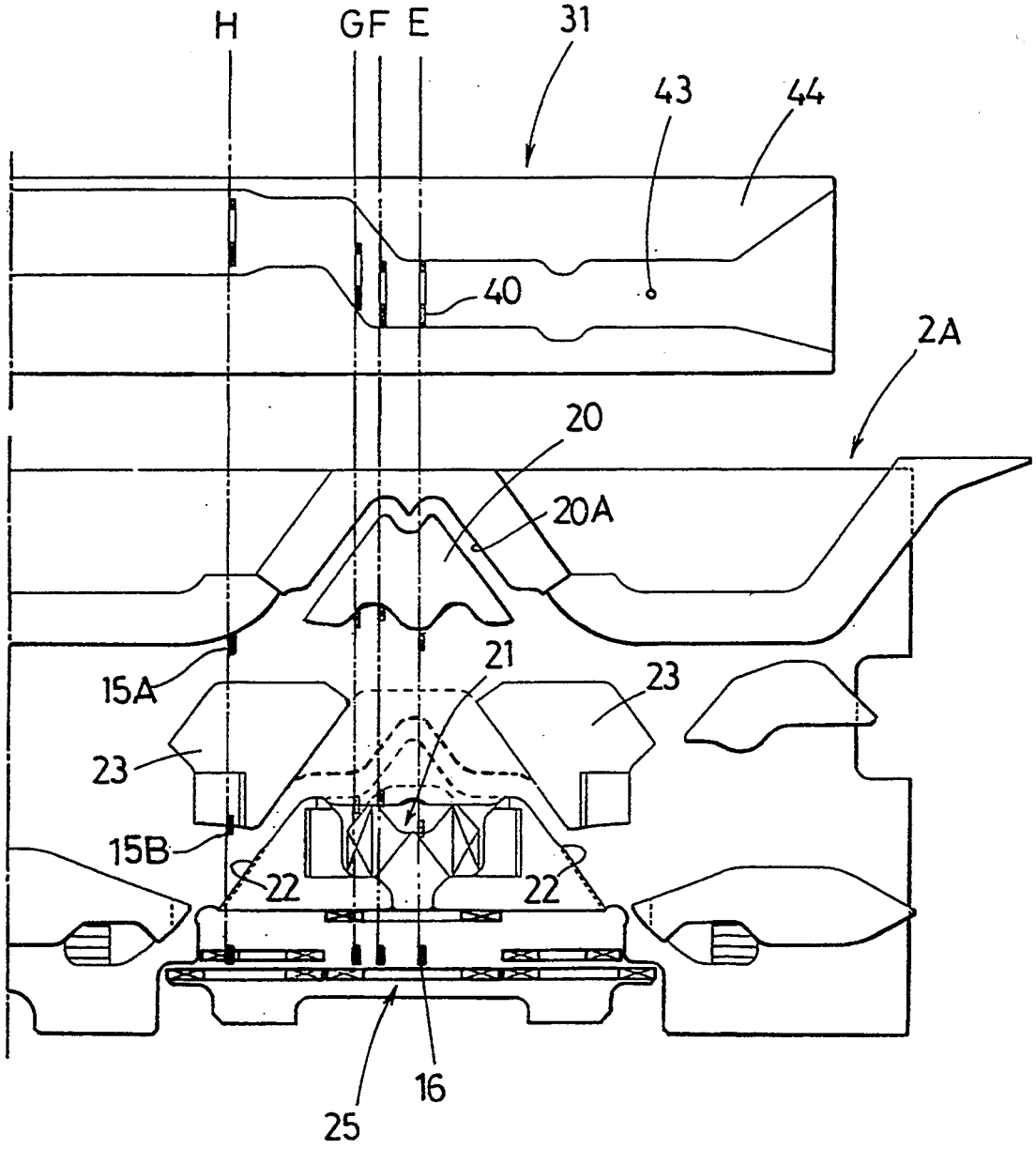
Figure 17:
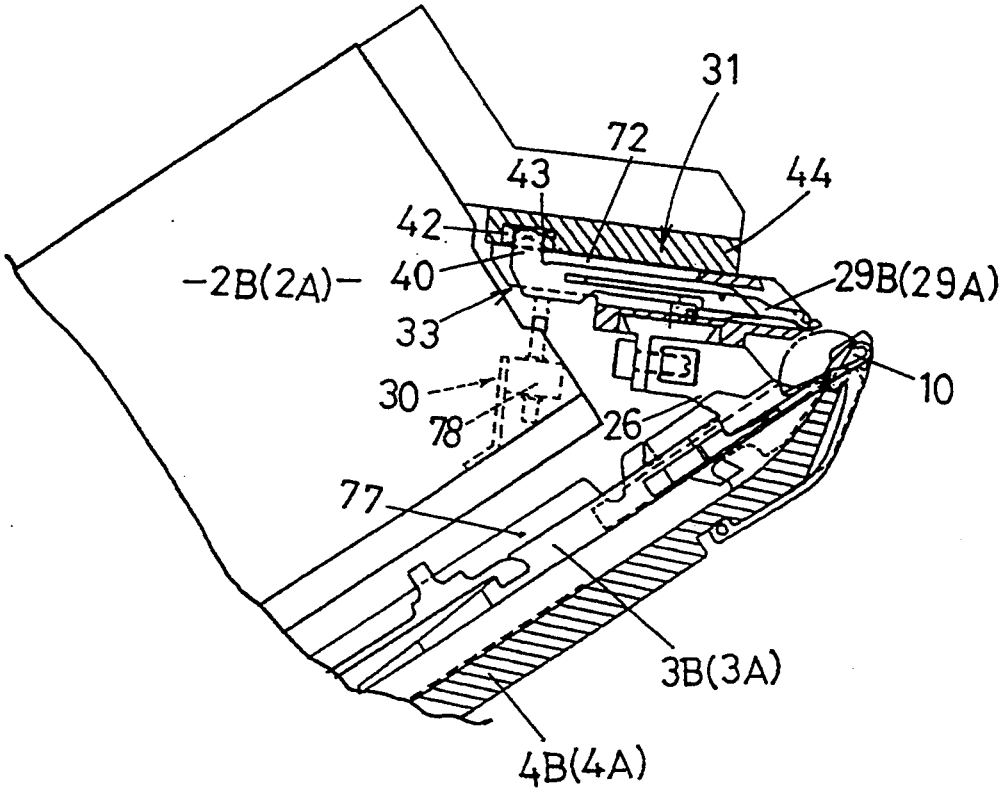
Figure 18:
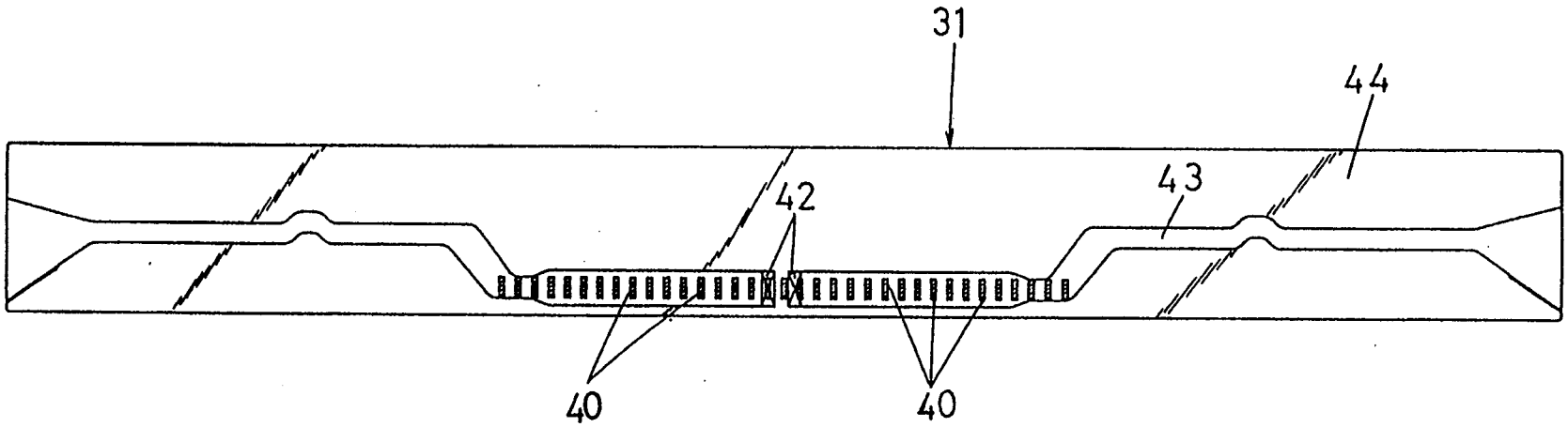
Figure 19:
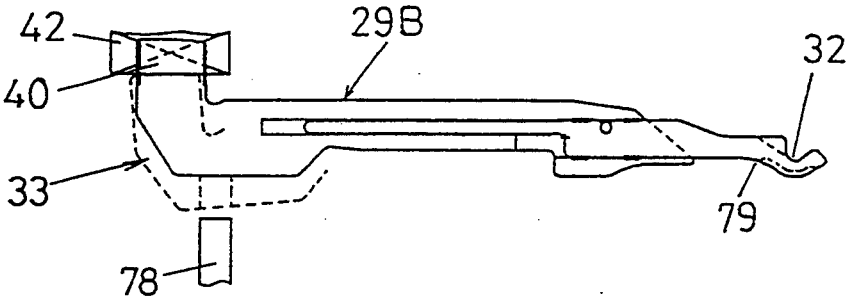
Figure 20:
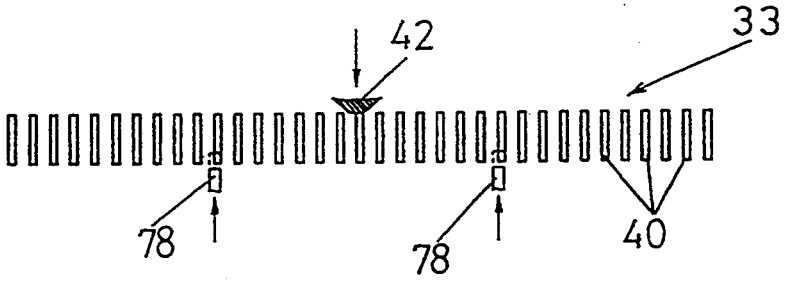

IN THE DRAWINGS:

FIG. 1 is a schematic partly cross sectional elevational view of the first embodiment of a flat knitting machine of the present invention;

FIG. 2 is a schematic partly cross sectional side view of the first embodiment of a flat knitting machine of the present invention;

FIG. 3 is a schematic enlarged cross sectional side view of the principal part of the first embodiment of a flat knitting machine of the present invention;

FIG. 4 is a side view of the portion involving the knitting needle and the transferring mechanism of the first embodiment of a flat knitting machine of the present invention;

FIG. 5 is a schematic elevational view of the group of cams of the carriage of the first embodiment of a flat knitting machine of the present invention;

FIG. 6 is a side view of the transferring jack of the first embodiment of a flat knitting machine of the present invention;

FIG. 7 is a bottom plan view of the transferring jack of the first embodiment of a flat knitting machine of the present invention;

FIG. 8 is a side view of the transferring jack of the first embodiment of a flat knitting machine of the present invention;

FIG. 9 is an elevational view of the transferring cam of the first embodiment of a flat knitting machine of the present invention;

FIG. 10 is a side view of the principal part illustrating the action of the transferring jack in FIG. 6 according to the first embodiment of a flat knitting machine of the present invention;

FIG. 11 is a side view of the principal part illustrating the action of the transferring jack in FIG. 8 according to the first embodiment of a flat knitting machine of the present invention;

FIG. 12 is a partly cross sectional elevational view of the cam plate and the return cam of the first embodiment of a flat knitting machine of the present invention;

FIG. 13 is an elevational view illustrating the groups of the cams of the carriage and the relationship between positions of the cam groove of the transferring cam and the knitting needle according to the first embodiment of a flat knitting machine of the present invention;

FIGS. 14A through 14D are side view of the relationship between positions of the knitting needle and the transferring jack in each position in FIG. 13;

FIG. 15 is an elevational view illustrating the groups of the cams of the carriage and the relationship between positions of the cam groove of the transferring cam and the knitting needle according to the first embodiment of a flat knitting machine of the present invention;

FIGS. 16A through 16D are side views of the relationship between positions of the knitting needle and the transferring jack in each position in FIG. 15;

FIG. 17 is a side view of the portion involving the knitting needle and the transferring mechanism of the second embodiment of a flat knitting machine of the present invention;

FIG. 18 is an elevational view of the transferring cam of the second embodiment of a flat knitting machine of the present invention;

FIG. 19 is a side view of the principal part illustrating the action of the transferring jack according to the second embodiment of a flat knitting machine of the present invention; and FIG. 20 is a schematic elevational view illustrating the relationship between the transfer jack selecting means and the selected member of the knitting needle according to the second embodiment of a flat knitting machine of the present invention.

DESCRIPTION OF THE PREFERRED EMBODIMENTS

First, a first embodiment of the present invention is described.

FIG. 1 is a schematic elevational view of a first embodiment of a flat knitting machine having a transferring mechanism, FIG. 2 is a side view of FIG. 1, and FIG. 3 is an enlarged cross-sectional side view of FIG. 2.

Referring to FIG. 1 through FIG. 3, reference numeral 1 designates the flat knitting machine. The knitting machine 1 comprises a flat front lower needle bed 4A and a flat rear lower needle bed 4B which are arranged facing each other to form an inverted V-shaped form in a side view, and each transferring mechanism 5 arranged above each needle bed 4A, 4B respectively. In each of the needle beds 4A, 4*b*, a number of knitting needles 3A, 3B, FIG. 3 are arranged, respectively, so as to be movable in needle grooves 77 by carriages 2A, 2B. The rear needle bed 4B is movable in transverse direction by a driving means which comprises a motor 6, a driving screw shaft 7, a slider 8, and the like (see FIG. 2).

Each transferring mechanism 5, arranged between carriages 2A and 2B, is supported by each of the flat transferring jack beds 27A, 27B (see FIG. 3). Each of the transferring jack beds 27A, 27B is supported by each supporting member 26 which is provided at each of the needle beds 4A, 4B via each slide mechanism 70. the transferring jack beds 27A and 27 B are connected to each other at the end portions thereof by moving control bracket 71. Control bracket 71 is driven by a driving means 69 which comprises a motor 66, driving screw shaft 67, slider 68, and the like (see FIG. 1 and FIG. 2).

By the needle beds 4A, 4B and the transferring mechanism 5, a stitch engaged with the knitting needle 3A on the front needle bed 4A can be transferred to the knitting needle 3B on the rear needle bed 4B or to a transferring jack 29A or 29B (referred to hereinafter) on the transferring jack bed 27A or 27B of the transferring mechanism 5. Also a stitch engaged with the knitting needle 3B on the rear needle bed 4B can be transferred to the knitting needle 3A on the front needle bed 4A or to the transferring jack 29A or 29B on the transferring jack bed 27A or 27B of the transferring mechanism 5.

Referring to FIG. 4, knitting needle 3A or 3B arranged in the needle groove 77 of the needle bed 4A or 4B comprises a knitting needle body 11 at the end of which a hook 10 is formed, a jack 12 which is connected to the rear end portion of the knitting needle body 11, a selecting jack 13 arranged at the rear portion of the jack 12, and a selector 14 arranged on the selecting jack 13. Butts 15A and 15B are projected upwardly from the jack 12, butt 16 is projected upwardly from the selector 14. When butts 15A, 15B, 16, and 17 move along a cam surface 76 of the carriages 2A, 2B, the jack 12, the selecting jack 13, and the selector 14 move in the needle groove 77.

An expanding member 18 for expanding a loop retained by the knitting 3A or 3B is arranged at a one side of the knitting needle body 11. The expanding member 18 is formed by bending sheet metal into a boat like shape, in plan view, and the end of the expanding member 18 is fixed to the one side of the knitting needle body 11.

Referring to FIG. 5, a group of cams of the carriages 2A and 2B over the needle beds 4A and 4B comprises two cam units arranged side by side. the cam unit comprises a transferring raising cam 20 protruded and retracted by a solenoid or a motor (not shown), a substantially trapezoid transferring receiving cam 21 arranged under the transferring raising cam 20, and can be protruded and retracted, needle raising cams 22 formed at the sides of the transferring receiving cams 21, and a convex portion 23 at the side of the needle raising cams 22. Under the group of cams, a needle selecting actuator 24 which acts on butts 17 of the selector 14 of the knitting needles 3A and 3B is arranged. Between the needle selecting actuator 24 and the group of cams, a pressor mechanism 25 which acts the butt 16 of the selecting jack 13 of the knitting needles 3A and 3B so that the knitting needles 3A and 3B are located at the position for knitting tucks or for transferring.

Referring to FIG. 3, in the transferring jack beds 27A and 27B, jack grooves 72 in which the transferring jack 29A and 29B are movably positioned are formed. On each transferring jack bed 27A or 27B, each transferring cam 31 and each transfer jack selecting mechanism 30 for selecting the transferring jacks 29A and 29B are positioned.

Referring to FIG. 6 through FIG. 8, a hook shaped stitch engaging portion 32 is formed at the front end of the transferring jack 29A (29B), a transfer jack selected member 33 is formed at the rear end of the transferring jack 29A (29B), and a curved portion 79 is formed at the jack body 34 side of the stitch engaging portion 32.

Two strip members 36, FIGS. 6 and 7 made from spring steel are extended from the opposite side portions of the jack body 34. The tip end portions of the strip members 36 are curved so that the tip of the strip member 36 contacted each other. The tip end portions of the strip members 36 are formed into hook shape to form a stitch engaging portion 32. One or both strip members 36 is curved near the opposite end portion of the strip member 36 to form a spring portion 37.

The transfer jack selected member 33 comprises a plate 38 with a length H, and a return butt 41 with which a return cam 42 (referred to hereinafter) acts. At the plate 38, a groove,with a width h, is formed and forms a transfer jack selected butt 40. The position of the transfer jack selected butt 40 in FIG. 6 is different from transfer jack selected butt 40' in FIG. 8, that is, the transfer jack selected butts 40 in Fig. 6 and the transfer jack selected butt 40 in FIG. 8 have different phases. According to this difference, the position of the return butt 41 in FIG. 6 is also different from the return butt 41' in FIG. 8. Transferring jack groups are formed from a plurality of transferring jacks 29A (29B) having the same transfer jack selected members 33 transferring jack groups of different selected members 33, 33' are arranged, alternatively, every 1 inch.

Referring to FIG. 3, the transferring cam 31 for acting the transfer jack selected butt 40, 40' of the transfer jack selected member 33, 33' as the case maybe and the return cam 42 for acting the return butt 41, 41' are arranged at the space between the carriage 2A (2B) on the needle bed 4A (4B) and a yarn guide arranged over an aperture between the needle beds 4A and 4B.

Referring to FIG. 3 and FIG. 9, the transferring cam 31 has a cam plate 44. A cam groove 43 with a width H is formed on the lower surface 44a of the cam plate 44 and the cam plate 44 protruded from the side portion of the carriage 2A (2B) so that the lower surface **44*a* of the cam late 44 is slidable on the upper surface of the transferring jack bed 27A (27B). The return cam 42 for acting the return butt 47, 41' is fixed to a bracket 55 which is fixed to the side portion of the carriage 2A (2B). At the center of the cam groove 43 of the cam plate 44, operation holes through which operating portion of an actuator 45 of a transfer jack selecting means 30 for operating the transfer jack selected butt 40** is provided.

Referring to FIG. 3, transfer jack selecting means 30 comprises a solenoid 49, a swinging lever 50, supporting axis 51, and a needle selecting cam plate. The solenoid 49 is fixed to casing 48 which is fixed to the carriage 2A (2B). The solenoid 49 is connected to the one each of the swinging lever 50 and the other end thereof is fixed to the supporting axis 51. The needle selecting cam plate 47 which passes through the operation hole 46 and operates as the operating portion of the actuator 45 is also fixed to the supporting axis 51. Different transfer jack selecting means 30 are arranged in transferring jack bed **27*a* or 27B, respectively, corresponding to the transferring jacks 29A (29B) (see FIG. 10 and FIG. 11**).

Referring to FIG. 12, at the low end portion of the cam plat 47, convex portions 74 are formed at the opposite ends of the lower end portion and a recess portion 75 is formed between the convex portions 74. Return cam 42, for acting the return butt 41 of the transferring jack 29A (29B), is arranged at the position facing to the recess portion 75.

Note, although the kinds of the transfer jack selected butt 40 forming the transfer jack selected member 33 is two in this embodiment, they may be three, or more.

The operation of the transferring mechanism 5 of the flat knitting machine will be explained as follows:

When the carriage 2A (2B) moves reciprocally on the needle bed 2A (2B), because each butt 15A, 15B, or 16 of the knitting needle 3A or 3B is operated by the cam surface 76 of the carriage 2A or 2B, the knitting needle 3A or 3B is moved reciprocally in the needle groove 77 and, thus, knitted goods are knitted by feeding yarn from a yarn feeder 61.

With usual knitting, the solenoid 49 of the transfer jack selecting means 30 of the transferring mechanism 5 maintains the swinging lever 47 in a standing position and therefore the transfer jack selected butt 40 which is in a waiting position is pushed downwardly not to be operated by the cam groove 43 of the cam plate 44 even though the carriage 2A (2B) moves. The transfer jack selected butt 40 which is pushed downwardly in a unoperated position is returned to the waiting position again by the return cam 42.

Accordingly, when the carriage 2A (2B) passes the edge portion of the knitting goods, because the transfer jack selecting means 30 of the transferring mechanism 5 exists outside of the transferring jack 29A (29B) to be selected and the transfer jack selected butts 40 of the transferring jacks 29A (29B) do not prevent the carriage 2A (2B) from moving even though the carriage 2A (2B) is moved in an adverse direction.

The case in which stitch is reduced is explained as follows. For convenience, the case in which the stitch 52 engaged to the front knitting needle 3A is transferred to the adjoining front knitting needle 3A is explained referring to FIG. 13 through FIG. 16.

Figure 14A:
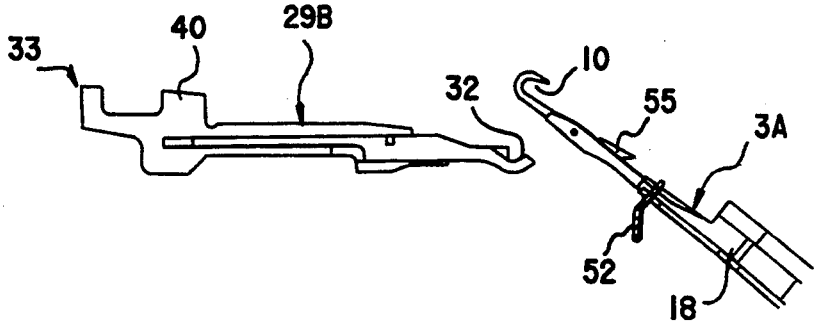
Figure 14B:
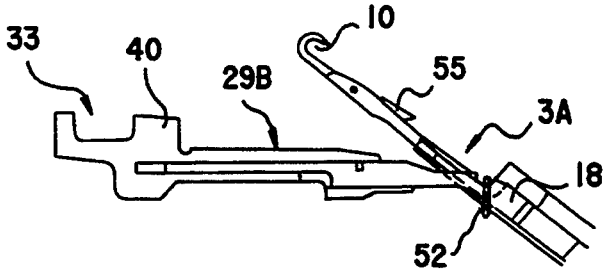

FIG. 13 designates the group of cams of the carriage 2A for moving the knitting needles 3A on the front needle bed 4A, and the cam groove 43 on the cam plate 44 for operating the transferring jacks 29B in the rear transferring jack bed 27B. When the carriage 2A is moved on the needle bed 4A from right to left, the butts 15A and 15B of the jack 12 of the knitting needle 3 and the butt 16 of the selecting jack 13 of the knitting needle 3 pass in the group of cams of the carriage 2 from left to right as shown symbols A, B, C, and D in FIG. 13. When the front knitting needle 3A reaches the position A in FIG. 13, the butt 15A of the jack 12 is gradually pushed upwardly by the transferring raising cam 20 and thus the front knitting needle 3A is raised gradually. Therefore, as shown in FIG. 14A, the stitch 52 opens the latch 55 and the stitch 52 is also opened by a opening member 18.

Figure 14C:
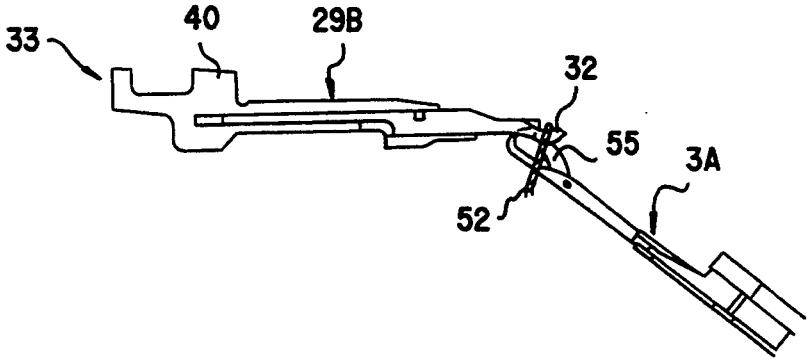

When the front knitting needle 3A reaches the position C in FIG. 13, as shown in FIG. 14C, the front knitting needle 3A is retracted gradually because the butt 15A of the jack 12 is gradually pushed downwardly, and the transfer jack selected butt 40 of the transferring jack 29B is pushed outwardly by the cam groove 43 of the cam plate 44 so that the stitch 52 does not interfere with the latch 55 when the front knitting needle 3A retracts.

Figure 14D:
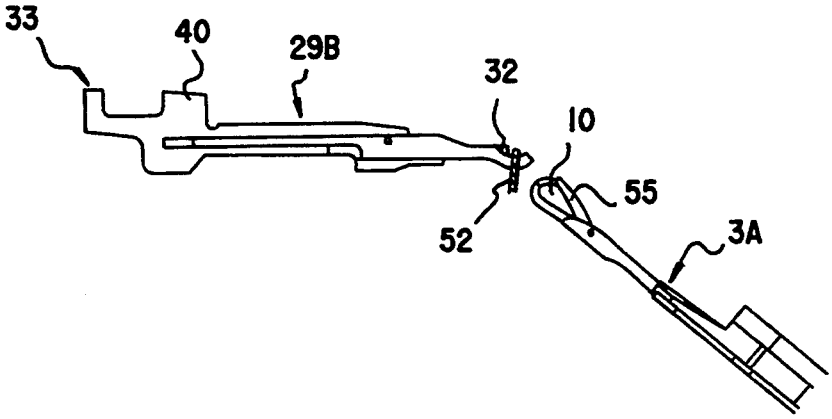

When the front knitting needle 3A reaches the position D in FIG. 13, the butt 15B of the jack 12 passes the convex cam 23. As shown in FIG. 14D, the stitch 52 engaged with the front knitting needle 3A has been transferred from needle 3A to the stitch engaging portion 32 of the transferring jack 29B.

When the group of cams of the carriage 2A passes the portion where the knitted goods is knitted, the transferring jack 29B keeps the stitch 52 at the stitch engaging portion 32.

Subsequently, the transferring jack bed 27B is moved transversely by predetermined pitches (for example one pitch) by the motor 66 via the driving screw shaft 67, the slider 68, and the move control bracket 71. At this time, because the curved portion 29, formed at the jack body 34 side of the stitch engaging portion 32, is positioned above the protruded member, like the sinker arranged at the aperture between the needle beds 4A and 4B, the transferring jack bed 27B can be moved transverse direction without interfering with the sinker or the knitting needles 3A and 3B.

Subsequently, when the carriage 2A (2B) is moved in an adverse direction along the needle bed 4A (4B), the butts 15A and 15B of the jack 12 of the knitting needle 3 and the butt 16 of the selecting jack 13 of the knitting needle 3 pass in the group of cams of the carriage 2 from right to left as shown by symbols E, F, G, and H in FIG. 15.

Figure 16A:
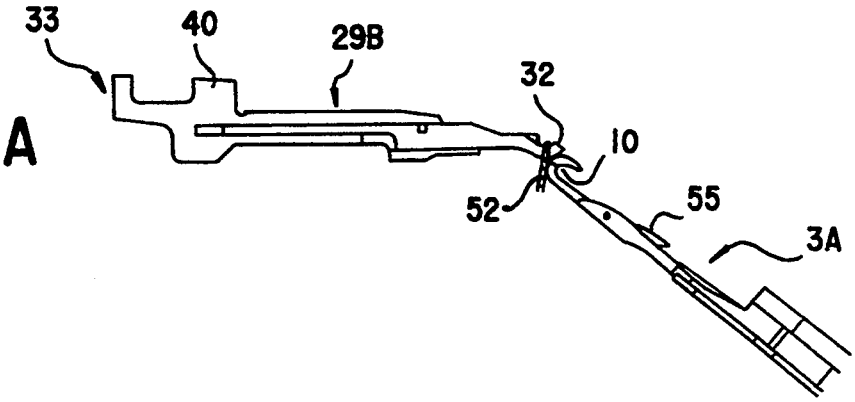
Figure 16B:
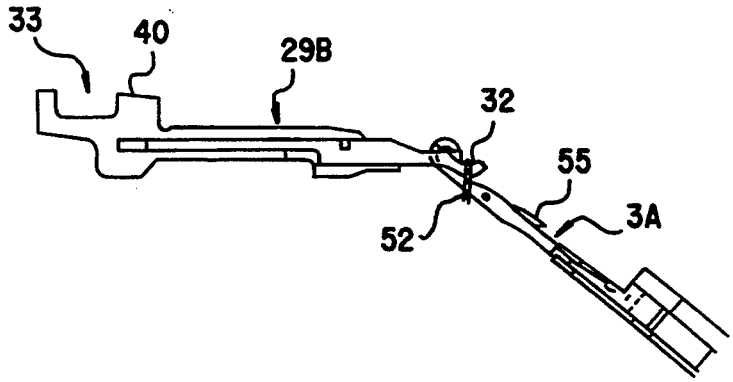

When the front knitting needle 3A, which receives the stitch 52, reaches from the position E to the position F in FIG. 15, as shown in FIG. 16a and FIG. 16B, the butt 15B of the jack 21 is operated by the transferring raising cam 20, the front knitting needle 3A is pushed outwardly, the hook 10 of the front knitting needle 3A is introduced into the transfer jack selected member 32, and the stitch 52 is engaged with hook 10.

Figure 16C:
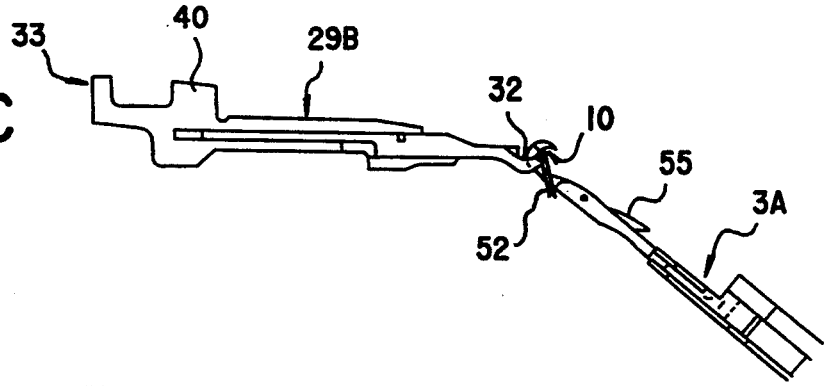

When the front knitting needle 3A reaches the position G in FIG. 15, the front knitting needle 3A is gradually retracted by the transferring raising cam 20, and the transferring jack 29B begins to retract because the transfer jack selected butt 40 of the transferring jack 29B is operated by the cam groove 43 of the cam plate 44. Therefore, as shown in FIG. 16c, the stitch 52 engaged with the stitch engaging portion 32 is transferred to the hook 10 of the front knitting needle 3A.

Figure 16D:
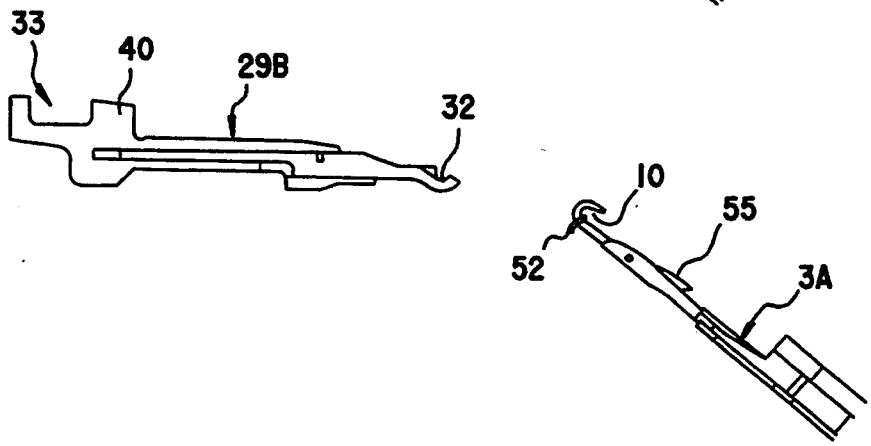

Subsequently, when the front knitting needle reaches the position H in FIG. 15, as shown in FIG. 16d., the transferring jack 29B is retracted further because the transfer jack selected butt 40 of the transferring jack 29B is pushed inwardly by the cam groove 43 of the cam plate 44, the front knitting needle 3A received the stitch 52 is also retracted. As a result, the transfer of the stitch is completed.

A second embodiment of the present invention is now described with reference to FIG. 17 through FIG. 20 The constitution and the operation of this embodiment is similar to them of the first embodiment except for the transfer jack selecting means 30 and the transfer jack selected butt 40.

Referring to FIG. 17 through FIG. 20, in the transfer jack selecting means 30' of this embodiment, the return cam 42' is arranged at the center of the cam groove 43' of the cam plate 44' which forms the transferring cam 31', and the solenoid actuators 78 which directly operate the transfer jack selected member 33 of the transferring jack 29A, 29B are arranged at both sides of the cam 42'.

According to this embodiment, the construction can be simplified comparing to the first embodiment in which the convex portions 74 are formed at both ends of the lower end portion of the transfer jack selecting cam plate 47 of the needle selecting means 30, a recess portion 75 is formed between the convex portions 74, and a plurality of the transferring jack 29A, 29B are operated by swinging the needle selecting cam plate 47 by the solenoid 49.

Furthermore, because the transfer jack selecting means 30' can be constructed by arranging the return cam 42' adjacent to the solenoids 78 which are arranged at both side of the return cam 42', when the transfer jack selecting means 30' is arranged at the middle of a plurality of the groups of cams provided at the carriage 2A, 2B, the carriage 2A, 2B can be miniaturized and also the width which the carriage 2A, 2B moves reciprocally can be shortened because the distance among the groups of cams can be shortened.

Note, in the embodiments, though only the rear needle bed is movable transversely, the front needle bed may be movable transverse direction or both the rear and the front needle beds may be movable transverse. Also, only the transferring jack bed may be movable and only either the rear or the front transferring jack be may be provided.

Furthermore, the relationship of the positions among the needle selected butts, actuator for operating these needle selected butts, the return cam, and the return butt may be upside down, and the number of the needle selected butts, the actuators for operating the needle selected butts, and the return cams can be determined free.

Although the invention has been described with reference to specific embodiments chosen for purpose of illustration, it should be apparent that numerous modification can be made without departing from the basic concept and scope of the invention.

What is claimed is:

1. A flat knitting machine having a transferring mechanism, said device comprising:

a pair of needle beds facing each other to form an inverted V-shaped form in a side view with an aperture formed between adjoining end portions of said needle beds;

knitting needles in needle grooves on said needle beds;

a yarn feeder above said aperture between said needle beds;

a carriage reciprocally movable on each needle bed of said pair of needle beds, and having a cam surface on a lower surface of said carriage for moving said knitting needles of said each needle bed forward and backward;

A transferring jack bed supported by a supporting member above said each needle bed, said each needle bed and said transferring jack bed being movable relative to each other;

a transferring jack having a transfer jack selected member movable forward and backward in a jack groove formed on each said transferring jack bed; said transfer jack selected member having a jack projecting upward and a return operation surface protruding downward at a tail portion of said transfer jack; and a transfer jack selecting means acting on said transfer jack selected member and arranged at an edge portion of each said carriage adjoining said aperture.

2. A flat knitting machine having a transferring mechanism according to claim 1, wherein said transfer jack selected member includes a transfer jack selected butt at a tail portion of said transferring jack, and an actuator for actuating said transfer jack selected butt.

3. A flat knitting machine having a transferring mechanism according to claim 1, wherein each said transferring jack bed includes a plurality of jack grooves, a first group of said jack grooves each having a transfer jack with a transfer jack selected member of a first phase and a second group of said jack grooves each having a transfer jack with a transfer jack selected member of a second phase, said transferring jack groups being formed into a plurality of transferring jacks of the same phase, and said transferring jack groups of said first and second phases being arranged alternatively.

4. A flat knitting machine having transferring mechanism according to claim 3, wherein said transfer jack selecting means comprises actuators for actuating said transfer jack selected butt, respectively, with said first and second phases and a return cam acting on said return operation surface for returning said transfer jack selected butt to a waiting position, said actuators being arranged in a row along a moving direction of each said carriage at a surface of each said carriage facing to said transfer jack selected member.

5. A flat knitting machine having transferring mechanism according to claim 3 or claim 4, wherein said actuator has two convex portions and a recess portion between said two convex portions facing a return cam.

* * * * *